US010351940B2

(12) United States Patent
Boswell

(10) Patent No.: US 10,351,940 B2
(45) Date of Patent: Jul. 16, 2019

(54) METHOD OF MANUFACTURING A COMPONENT FROM A NICKEL-BASED SUPERALLOY

(71) Applicant: ROLLS-ROYCE plc, London (GB)

(72) Inventor: John H Boswell, Derby (GB)

(73) Assignee: ROLLS-ROYCE plc, London (GB)

( * ) Notice: Subject to any disclaimer, the term of this patent is extended or adjusted under 35 U.S.C. 154(b) by 105 days.

(21) Appl. No.: 15/685,642

(22) Filed: Aug. 24, 2017

(65) Prior Publication Data

US 2018/0073120 A1 Mar. 15, 2018

(30) Foreign Application Priority Data

Sep. 15, 2016 (GB) ..... 1615671.3

(51) Int. Cl.

| | |
|---|---|
| ***C22F 1/10*** | (2006.01) |
| ***B22D 27/04*** | (2006.01) |
| ***B24C 1/10*** | (2006.01) |
| ***F01D 5/28*** | (2006.01) |
| *B24C 1/08* | (2006.01) |
| *C21D 7/06* | (2006.01) |

(52) U.S. Cl.

CPC ..... *C22F 1/10* (2013.01); *B22D 27/045* (2013.01); *B24C 1/10* (2013.01); *F01D 5/286* (2013.01); *B24C 1/08* (2013.01); *C21D 7/06* (2013.01); *F05D 2230/10* (2013.01); *F05D 2230/211* (2013.01); *F05D 2230/26* (2013.01); *F05D 2230/42* (2013.01); *F05D 2250/621* (2013.01); *F05D 2250/63* (2013.01)

(58) Field of Classification Search

CPC ..... C22F 1/10; C22C 19/05; C22C 19/051; C22C 19/053; C22C 19/052; C22C 19/055; C22C 19/057

See application file for complete search history.

(56) References Cited

U.S. PATENT DOCUMENTS 6,344,097 B1 * 2/2002 Limoges ..... C22F 1/10 148/592

2009/0119920 A1 5/2009 Peschke et al.

FOREIGN PATENT DOCUMENTS

| | | | |
|---|---|---|---|
| CA | 814394 | A | 6/1969 |
| EP | 0150917 | A2 | 8/1985 |
| WO | 2015/116352 | A1 | 8/2015 |

OTHER PUBLICATIONS

Jan. 23, 2018 Search Report issued in European Patent Application No. 17 18 7631.

Jan. 16, 2017 Search Report issued in British Patent Application No. 1615671.3.

* cited by examiner

*Primary Examiner* — Jessee R Roe

(74) *Attorney, Agent, or Firm* — Oliff PLC

(57) ABSTRACT

A method of manufacturing a component from a nickel-based superalloy comprises the steps of:

providing a vacuum induction casting furnace;

positioning a component mould onto a chill plate within the furnace;

casting a component blank;

peening the surface of the component blank;

applying a surface modification technique to the surface of the component blank;

solution heat treating the component blank at or above the γ'-solvus temperature for the superalloy; and precipitation heat treating the component blank.

12 Claims, 5 Drawing Sheets

METHOD OF MANUFACTURING A COMPONENT FROM A NICKEL-BASED SUPERALLOY

This disclosure claims the benefit of UK Patent Application No. GB 1615671.3, filed on 15 Sep. 2016, which is hereby incorporated herein in its entirety.

FIELD OF THE DISCLOSURE

The present disclosure relates to a method of manufacturing a metallic component from a nickel-based superalloy and particularly, but not exclusively, to a method of manufacturing a compressor blade for a gas turbine engine from a nickel-based superalloy.

BACKGROUND TO THE DISCLOSURE

FIG. 1 shows a partial cross-section of a turbofan gas turbine engine that comprises, in flow series, an intake 11, a fan 12, an intermediate pressure compressor 13, a high pressure compressor 14, a combustion chamber 15, a high pressure turbine 16, an intermediate pressure turbine 17, a low pressure turbine 18 and an exhaust 19. The high pressure turbine 16 is arranged to drive the high pressure compressor 14 via a first shaft 26. The intermediate pressure turbine 17 is arranged to drive the intermediate pressure compressor 13 via a second shaft 28 and the low pressure turbine 18 is arranged to drive the fan 12 via a third shaft 30. In operation air flows into the intake 11 and is compressed by the fan 12. A first portion of the air flows through, and is compressed by, the intermediate pressure compressor 13 and the high pressure compressor 14 and is supplied to the combustion chamber 15. Fuel is injected into the combustion chamber 15 and is burnt in the air to produce hot exhaust gases which flow through, and drive, the high pressure turbine 16, the intermediate pressure turbine 17 and the low pressure turbine 18. The hot exhaust gases leaving the low pressure turbine 18 flow through the exhaust 19 to provide propulsive thrust. A second portion of the air bypasses the main engine to provide propulsive thrust.

It is known to improve cycle efficiency of a gas turbine by increasing, for example, the high pressure spool rotational speed and the high pressure compressor exit temperature. Current developments are targeting temperatures of over 1000K at the exit from the high pressure compressor. This temperature is above the operating temperature of current metal alloy materials used for the high pressure compressor blades such as, for example, Nimonic® N105.

Some high temperature nickel-based superalloy materials cannot be forged because of their creep resistance. Examples include Inconel® 713, Inconel® 738, and CM247LC (produced by Cannon Muskegan)

Conventional manufacturing techniques for compressor rotor blades involve the use of closed die forging followed by machining. The types of superalloys required to operate at in the above-mentioned high temperature environments cannot be forged due to their high temperature strengths and low ductility. For these reasons only casting or powder metallurgy processes such as metal injection moulding would be suitable.

At normal forging temperatures, such materials have too high a yield stress to allow them to be forged. However, if the forging temperature is increased to the level at which forging could take place, there would be a risk of incipient melting of the superalloy material. In other words, at a temperature high enough to plastically deform the superalloy material, the temperature would be close to the start of the melting range for the superalloy.

Investment casting could be used to produce compressor rotor blades in high temperature superalloys. A disadvantage of such a method is that the resulting grain structure is coarser than that obtainable from forging techniques. FIG. 2 shows a schematic sectional view of a cast component according to the prior art. The component 40 has been cast into a mould 42. The exposed surface of the cast component shows some shrinkage 44. The surface in contact with the mould comprises a chill zone 46 in which the grain structure of the material is fine. Extending further into the cast component from this chill zone 46, the grain structure is initially columnar 48. Extending into the core of the cast component, the grain structure becomes equi-axed 50. This variation in grain structure is deleterious to the mechanical properties of the component.

In addition, the grain structure is less uniform, because the grain structure is highly dependent on cooling rates and the direction of heat flux from the mould. This would require an additional grain refinement step in order to achieve a fine uniform grain structure.

Alternatively, metal injection moulding could be used to produce compressor rotor blades from high temperature superalloys. A disadvantage of the metal injection moulded components is that the resulting material properties tend to be inferior to those of forged components. Furthermore, the cost of tooling and the powder material results in the metal injection moulding process being more expensive than casting.

STATEMENTS OF DISCLOSURE

According to a first aspect of the present disclosure there is provided a method of manufacturing a component from a nickel-based superalloy, the method comprising the steps of:

- providing a vacuum induction casting furnace;
- positioning a component mould onto a chill plate within the furnace;
- casting a component blank into the mould;
- peening the surface of the component blank;
- applying a surface modification technique to the surface of the component blank;
- solution heat treating the component blank at or above the γ'-solvus temperature for the superalloy; and
- precipitation heat treating the component blank.

The method of the disclosure utilises a casting technique to prepare a component blank that is subsequently subjected to a specific sequence of processing steps to thereby arrive at a finished component that can be operated at high temperatures with enhanced high cycle and low cycle fatigue properties.

The use of a vacuum induction casting furnace enables the mould (positioned within the furnace) to be thoroughly heat soaked before casting the component. This avoids the problem of mis-runs in the component blank.

The use of a vacuum induction furnace also enables the temperature of the mould to be more accurately controlled than for conventional furnaces. This in turn enables the component blank to be cast at a temperature that ensures complete mould filling.

The use of a chill plate within the mould cavity facilitates rapid cooling of the cast component blank after its withdrawal from the furnace to maintain a single crystal structure within the component blank.

Peening the surface of the component blank will induce a compressive stress layer in the surface of the component blank. This in turn will produce dislocations in the structure of the surface layer, which will act as nucleation sites for recrystallization during the subsequent heat treatment.

The surface modification step improves the surface finish of the component blank whilst also producing a residual compressive stress in the surface layer of the component blank. In the same way as outlined above for the peening process, this compressive stress will produce dislocations in the structure of the surface layer, which will act as nucleation sites for recrystallization during the subsequent heat treatment.

The solution heat treatment and subsequent precipitation heat treatment will follow a standard process dependent upon the superalloy composition selected. During the solution heat treatment, the residual stresses produced by the peening and that produced by the surface modification step will result in further recrystallization and grain refinement of the superalloy structure. Performing the solution heat treatment at or above the γ'-solvus temperature for the superalloy ensures the recrystallization and grain refinement of the superalloy structure.

The solution heat treatment and the precipitation heat treatment cycles would be arranged so as to achieve an optimum grain size for the desired combination of creep and fatigue properties for the component.

Optionally, the step of peening the surface of the component blank comprises the subsequent step of:

hot isostatic pressing the peened surface of the component blank at or above the γ'-solvus temperature for the superalloy.

The hot isostatic pressing step will close any sub-surface pores in the cast component blank whilst allowing the recrystallization of the grain structure to begin.

Performing the hot isostatic pressing step at or above the γ'-solvus temperature for the superalloy ensures the recrystallization of the grain structure.

Optionally, the step of casting a component blank comprises the step of:

casting a component blank using an investment casting process.

The use of an investment casting process enables metal superalloys having good high temperature properties to be used to form a component blank.

Optionally, the step of peening the surface of the component blank comprises the further initial step of:

cleaning the surface of the component blank using abrasive media.

Cleaning the surface of the component blank using abrasive media allows the subsequent peening operation to more effectively induce a compressive stress layer uniformly across the surface of the component blank.

Optionally, the hot isostatic pressing step has a duration of approximately 60 minutes.

Restricting the duration of the hot isostatic pressing step to approximately 60 minutes allows recrystallization to occur in the structure of the surface of the component blank, while ensuring that the recrystallized grains do not coarsen.

Optionally, the surface modification technique is a vibro-polishing process.

Vibro-polishing is a process in which a component is immersed in a container together with shaped media, and then subjected to a vibratory action.

Optionally, the vibro-polishing process is a burnishing process.

In one arrangement of the method, the vibro-polishing process is a burnishing process.

Optionally, the surface modification technique is a cold rolling process.

In an alternative arrangement, the vibro-polishing process is a cold rolling process.

Optionally, the step of hot isostatic pressing the peened surface of the component blank, comprises the further step of:

rough machining at least part of the component blank.

Depending on the quantity of material that is needed to be removed from the component blank in order to form the finished component, it may be expedient to use a rough machining process to remove the majority of this material prior to heat treatment.

The process of rough machining will also induce some plastic deformation in the surface layer of the component blank. This will result in further recrystallization and grain refinement during the subsequent heat treatment.

Optionally, the method further comprises the step of finish machining the component blank.

It is likely that the component blank will require some final machining after the completion of the heat treatment processes. This may take the form of any suitable process for use on heat treated components such as, for example, grinding.

According to a second aspect of the present disclosure there is provided a turbomachine component manufactured by a method according to the first aspect.

As detailed above, turbomachine components are particularly suitable for manufacture by the method of the disclosure because of their need for a material having good high temperature properties and the inability of such materials to be forged.

According to a third aspect of the present disclosure there is provided a compressor blade for a gas turbine engine, wherein the compressor blade is manufactured by a method according to the first aspect.

Other aspects of the disclosure provide devices, methods and systems which include and/or implement some or all of the actions described herein. The illustrative aspects of the disclosure are designed to solve one or more of the problems herein described and/or one or more other problems not discussed.

BRIEF DESCRIPTION OF THE DRAWINGS

There now follows a description of an embodiment of the disclosure, by way of non-limiting example, with reference being made to the accompanying drawings in which.

It is noted that the drawings may not be to scale. The drawings are intended to depict only typical aspects of the disclosure, and therefore should not be considered as limiting the scope of the disclosure. In the drawings, like numbering represents like elements between the drawings.

DETAILED DESCRIPTION

Figure 1:
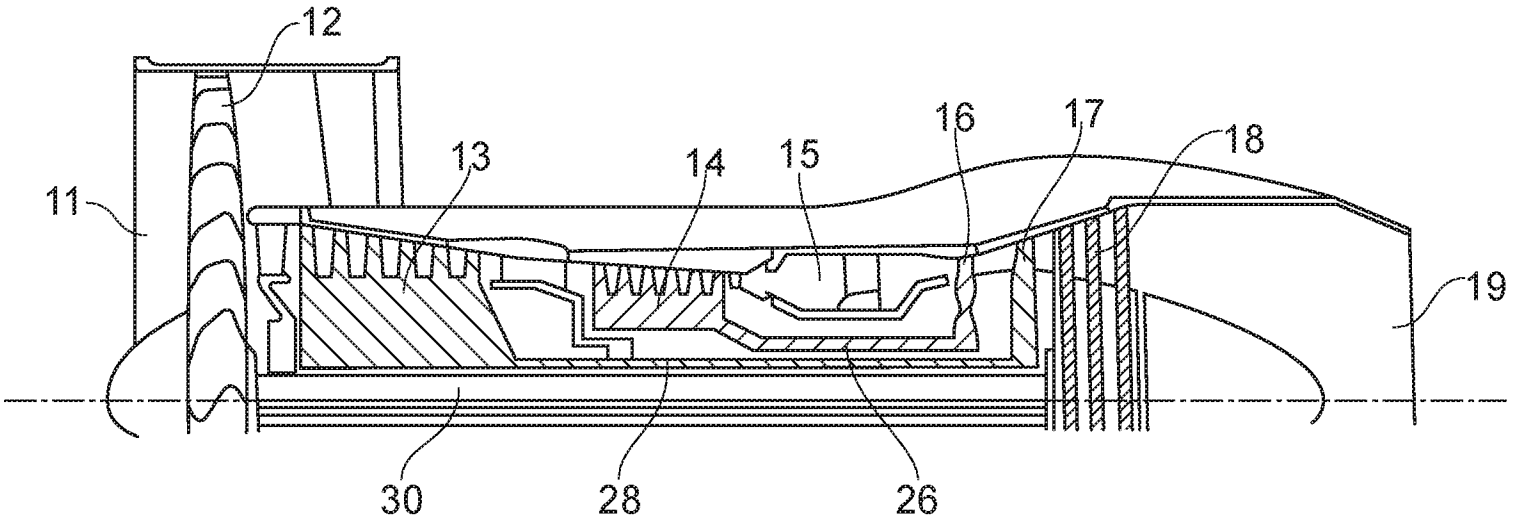
FIG. 1 shows a schematic part-sectional view of a gas turbine engine comprising a compressor blade made according to the present disclosure.
Figure 2:
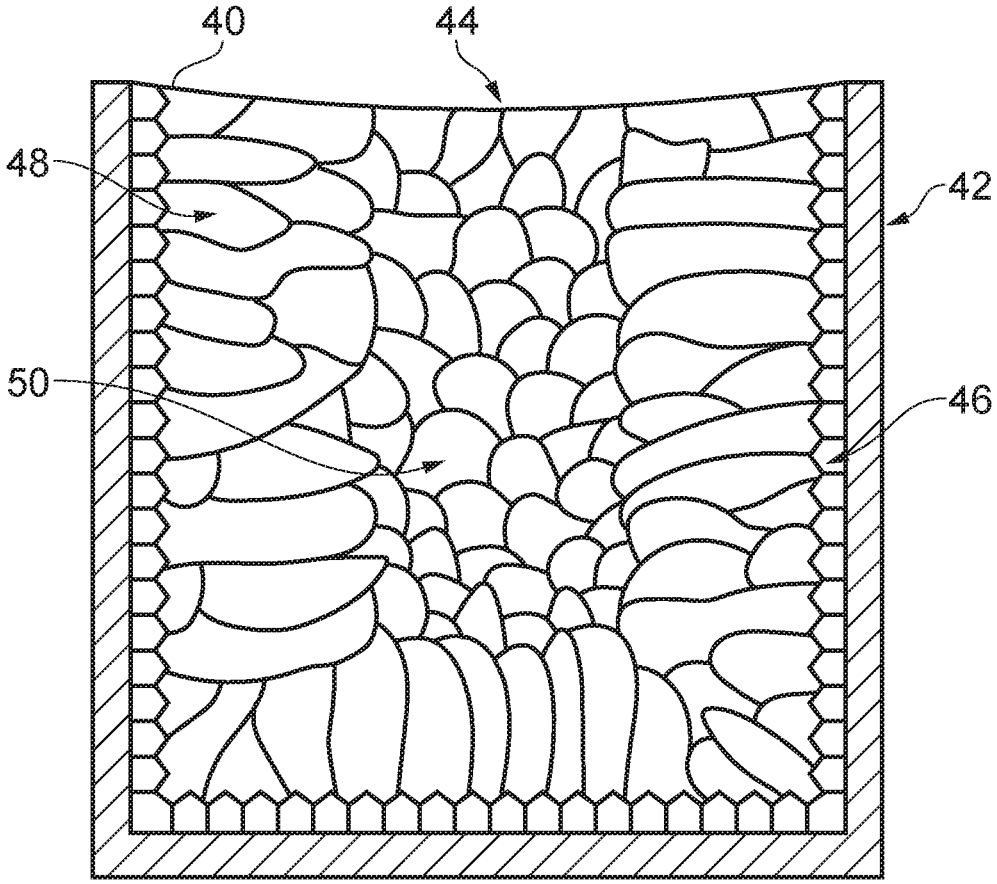
FIG. 2 shows a schematic sectional view of a cast grain structure resulting from a prior art casting process.
Figure 3:
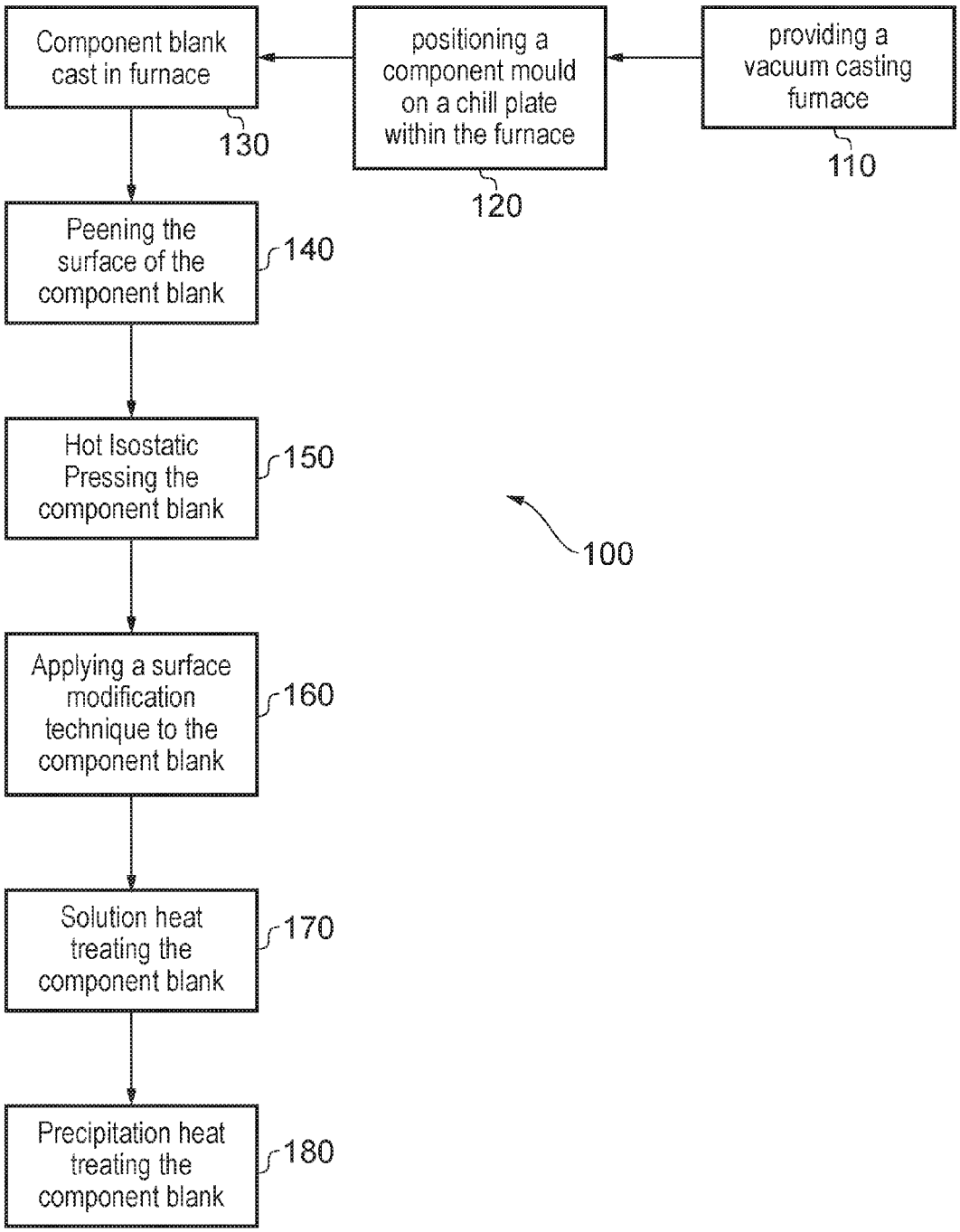
FIG. 3 shows a flow chart of a method of manufacturing a component according to a first embodiment of the disclosure.
Figure 4:
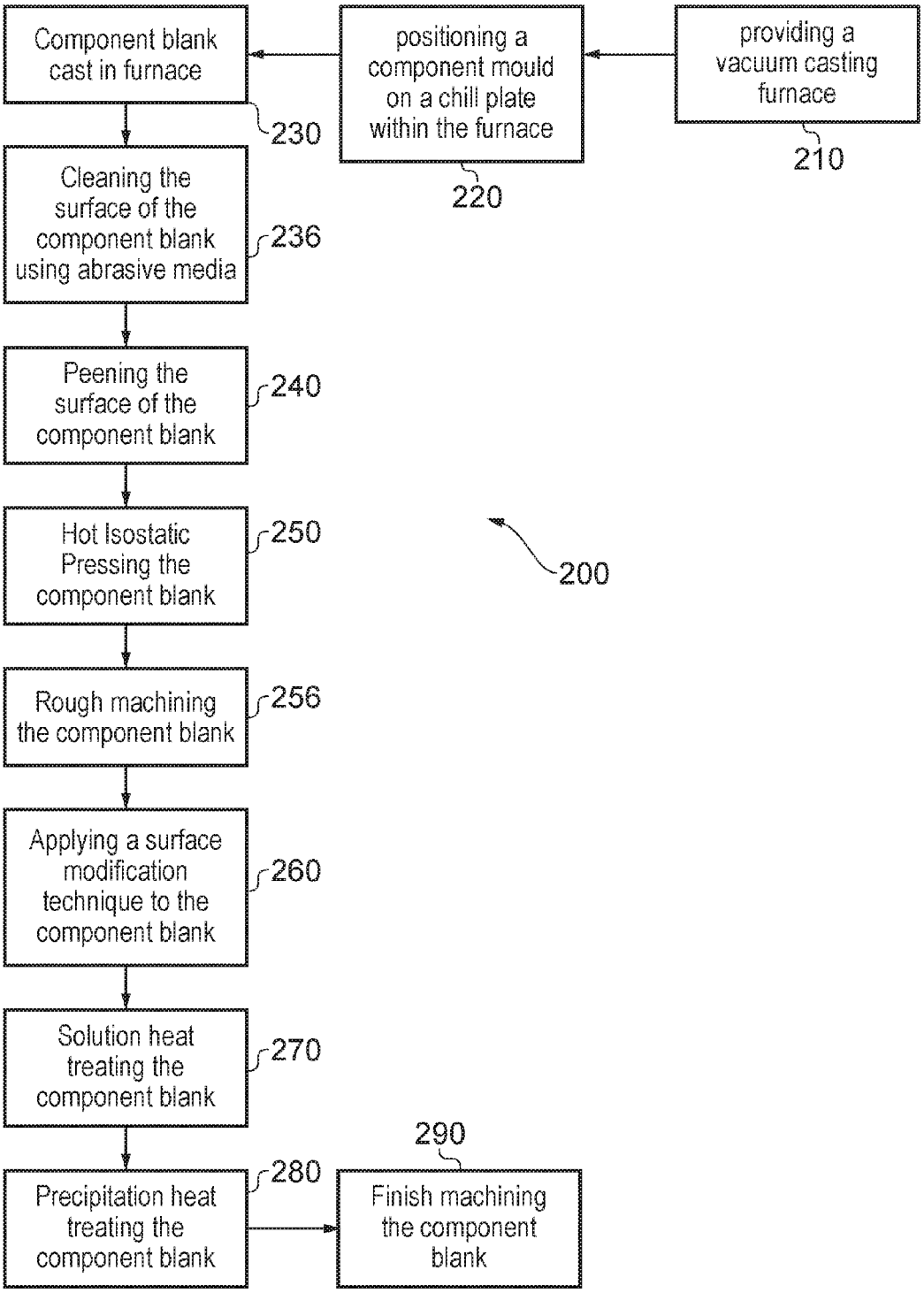
FIG. 4 shows a flow chart of a method of manufacturing a component according to a second embodiment of the disclosure.
Figure 5:
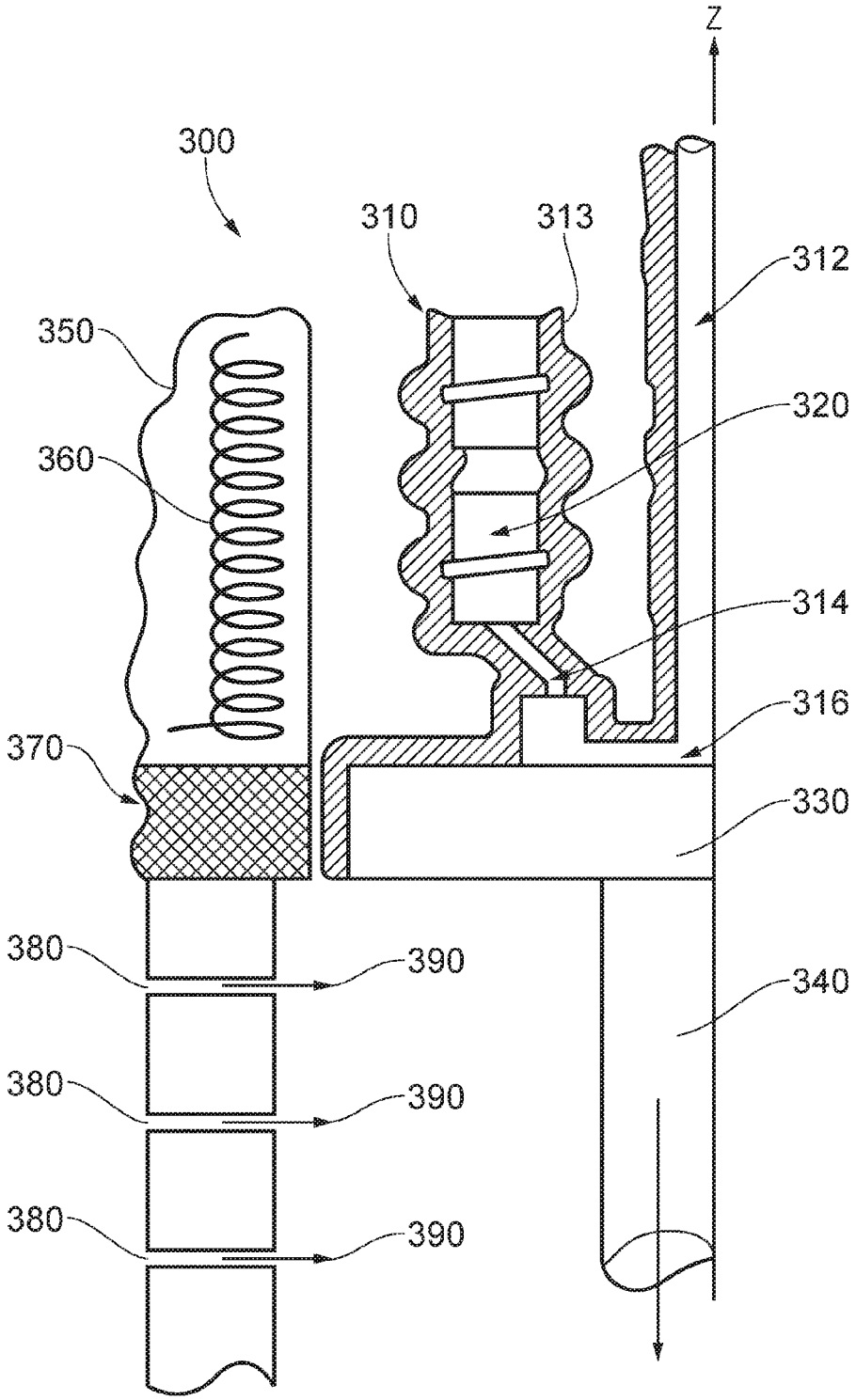
FIG. 5 shows a schematic part-sectional view of a mould positioned within a furnace, suitable for use with the method of the present disclosure.

Referring to FIG. 3 a method of manufacturing a component according to a first embodiment of the disclosure is designated generally by the reference numeral 100. FIG. 5 illustrates an example furnace arrangement that could be used with the method of the present disclosure.

The furnace 300 provided at step 110 is a vacuum casting furnace of a conventional nature. No further explanation of the structure and function of the furnace is provided as this would be understood by a skilled person.

At step 120, a mould assembly 310 is positioned on a chill plate 330 within the furnace 300. The mould assembly 310 is heated to a temperature of approximately 30° C. or 40° C. above the liquidus temperature of the superalloy being cast. In the present embodiment, this will be approximately 1430° C.

In the present arrangement, the chill plate is a copper chill plate. The chill plate facilitates the rapid cooling of the case component blanks following their withdrawal from the furnace.

The mould assembly 310 comprises a central sprue 312 from which extend a number of component moulds 313. Each of these component moulds 313 will house at least one rotor blade casting 320.

At step 130, a component blank, in this case a turbine blade blank, is cast into the component mould 313.

In the embodiment shown in FIG. 5, a restrictor 316 is provided between the central sprue 312 and each of the component moulds 313. This restrictor 316 acts to further prevent the directionally solidified grain structure of the solidifying sprue material from entering the blade cavity.

In the embodiment shown in FIG. 5, each of the component blanks 320 is oriented perpendicularly to the chill plate. In another arrangement, each of the component moulds 313 could extend radially outwardly from the central sprue 312. In other words, the components blanks 320 could be oriented perpendicularly to the central sprue 312.

After removal from the component mould 310, each of the component blanks 320 is fettled to remove extraneous sprue material.

At step 140, the component blank 320 is subjected to a peening process, for example by bead blasting. This induces a compressive stress layer immediately below the surface of the component blank 320.

The plastic deformation associated with this compressive stress layer will produce dislocations that will act as nucleation sites for recrystallization during later heat treatment of the component blank 320.

At step 150, the peened component blank 320 is subjected to a hot isostatic pressing (HIP) operation for a period of approximately 1 hour. The compressive stress produced by the pressing operation acts to close any sub-surface pores in the component blank 320. The elevated temperature of the process allows some recrystallization to take place in the microstructure of the component blank 320. The duration of the HIP process is selected to allow only a pre-determined degree of recrystallization.

At step 160, the component blank 320 is subjected to a burnishing process to improve the surface finish of the component blank 320, whilst also producing a residual compressive stress in the component surface. As outlined above in relation to the peening process, the residual compressive stress resulting from the burnishing process promotes further recrystallization during subsequent heat treatment.

Step 170 involves subjecting the component blank 320 to a standard solution heat treatment process. The solution heat treatment process will be selected in dependence on the composition of the metal alloy used for the component blank 320.

At step 180, the component blank is subjected to a standard precipitation heat treatment process. As for the heat treatment process of step 170, the parameters for the heat treatment process of step 180 will be selected on the basis of the composition of the metal superalloy used for the component blank 320.

Referring to FIG. 3, a method of manufacturing a component according to a second embodiment of the disclosure is designated generally by the reference numeral 200. Features of the method 200 which correspond to those of method 100 have been given corresponding reference numerals for ease of reference.

The method 200 comprises all of the steps of the method 100 with the addition of three additional steps 236, 256 and 290.

Step 236 involves cleaning the surface of the component blank 320 prior to the burnishing operation of step 240. The blasting may be required where the surface of the component blank 320 is not sufficiently clean for the peening operation to uniformly induce the compressive stress layer in the surface of the component blank 320.

At step 256 some or all of the surface of the component blank 320 may be rough machined to bring the geometry of the component blank closer to, if to directly to, the required geometry of the finished component. This step may be advantageous because it will be easier to remove material from the surface of the component blank before the heat treatment processes than it will be after these have been carried out.

Step 290 involves finish machining the component blank. Depending upon the complexity of the geometry of the finished component, it may not be necessary to further machine the surface of the component blank.

Except where mutually exclusive, any of the features may be employed separately or in combination with any other features and the disclosure extends to and includes all combinations and sub-combinations of one or more features described herein.

The foregoing description of various aspects of the disclosure has been presented for purposes of illustration and description. It is not intended to be exhaustive or to limit the disclosure to the precise form disclosed, and obviously, many modifications and variations are possible. Such modifications and variations that may be apparent to a person of skill in the art are included within the scope of the disclosure as defined by the accompanying claims.

What is claimed is:

1. A method of manufacturing a component from a nickel-based superalloy, the method comprising the steps of:

providing a vacuum induction casting furnace;

positioning a component mould onto a chill plate within the furnace;

casting a component blank;

peening the surface of the component blank;

applying a surface modification technique to the surface of the component blank;

solution heat treating the component blank at or above the γ'-solvus temperature for the superalloy; and precipitation heat treating the component blank.

2. The method as claimed in claim 1, wherein the step of peening the surface of the component blank comprises the subsequent step of:

hot isostatic pressing the peened surface of the component blank at a temperature at or above the γ'-solvus temperature for the superalloy.

3. The method as claimed in claim 2, wherein the hot isostatic pressing step has a duration of approximately 60 minutes.

4. The method as claimed in claim 1, wherein the step of casting a component blank comprises the step of:

casting a component blank using an investment casting process.

5. The method as claimed in claim 1, wherein the step of peening the surface of the component blank comprises the further initial step of:

cleaning the surface of the component blank using abrasive media.

6. The method as claimed in claim 1, wherein the surface modification technique is a vibro-polishing process.

7. The method as claimed in claim 6, wherein the vibro-polishing process is a burnishing process.

8. The method as claimed in claim 1, wherein the surface modification technique is a cold rolling process.

9. The method as claimed in claim 1, wherein the step of hot isostatic pressing the peened surface of the component blank, comprises the further step of:

rough machining at least part of the component blank.

10. The method as claimed in claim 1, wherein the method further comprises the step of finish machining the component blank.

11. A turbomachine component manufactured by a method as claimed in claim 1.

12. A compressor blade for a gas turbine engine, wherein the compressor blade is manufactured by a method as claimed in claim 1.

* * * * *